US006609692B1

(12) United States Patent
Muresan et al.

(10) Patent No.: US 6,609,692 B1
(45) Date of Patent: Aug. 26, 2003

(54) PROCEDURE TO ATTACH A LAMP ON A CEILING

(76) Inventors: David Darian Muresan, 18204 30th Ave. NE., Seattle, WA (US) 98155; David Muresan, 18204 30th Ave. NE., Seattle, WA (US) 98155

( * ) Notice: Subject to any disclaimer, the term of this patent is extended or adjusted under 35 U.S.C. 154(b) by 235 days.

(21) Appl. No.: 08/669,674

(22) Filed: May 24, 1996

(51) Int. Cl.[7] ..... H04R 1/02; B42F 13/00
(52) U.S. Cl. ..... 248/343; 362/148
(58) Field of Search ..... 248/343, 342, 248/317, 329, 222.14, 57, 118.1; 362/20, 147, 148, 150, 216, 277, 368, 369

(56) References Cited

U.S. PATENT DOCUMENTS 4,733,339 A * 3/1988 Kelsall ..... 362/366
4,760,510 A * 7/1988 Lahti ..... 362/365
4,763,231 A * 8/1988 Houplain ..... 362/148
4,999,748 A * 3/1991 Aoshika ..... 362/147
5,068,772 A * 11/1991 Shapiro et al. ..... 362/365

FOREIGN PATENT DOCUMENTS

JP 08009480 A * 1/1996

* cited by examiner

*Primary Examiner*—Anita King

(57) ABSTRACT

A procedure to attach securely a lamp on a ceiling allowing easy electrical connection and the use of a lamp with the most elegant upper end. This is possible by using a spring to support the lamp, which will allow to pull down the lamp in order to do the electrical connection. The electrical wires come through ceiling and are covered by the upper end of the lamp. The lamp released will be pressed against the ceiling by the spring.

2 Claims, 4 Drawing Sheets

PROCEDURE TO ATTACH A LAMP ON A CEILING

BACKGROUND OF THE INVENTION

1. Field of the invention

This invention refers to a procedure that attaches securely a lamp on a ceiling using a spring.

2. Prior Art Statement

The existing procedure to attach a lamp on a ceiling FIG. 2 uses a movable part 3 on the lamp, fixed with a screw 6, in order to cover the hook 4 and the hardware 5 screwed in the ceiling structure 2 (ex. 2×6 wood) and electrical connectors.

The disadvantages of this procedure are:

1. The movable part 3 requires a portion of the lamp to move on, which will increase the length of the lamp and limits the art work of the lamp especially in the upper end. The movable part and the screw 6 reduce the lamp's upper end elegance.
2. The lamp isn't pressed against the ceiling, so if the lamp is touched, it will move (oscillate ) for a while.

OBJECT AND SUMMARY OF THE INVENTION

The object of this invention is to eliminate the disadvantages of the existing procedure. In order to do this, the lamp is attached on a ceiling with a proper spring 10 (FIG. 1), which hooks the lamp, allows to connect the electric power and keeps the lamp pressed against the ceiling, so that the lamp will not oscillate. Thus the lamp will have the most elegant upper end.

BRIEF DESCRIPTION OF THE DRAWINGS

The description is related with the FIG. 1, FIG. 1*a*, FIG. 2, FIG. 3 and FIG. 4, which represent.

DESCRIPTION OF THE INVENTION

Figure 1:
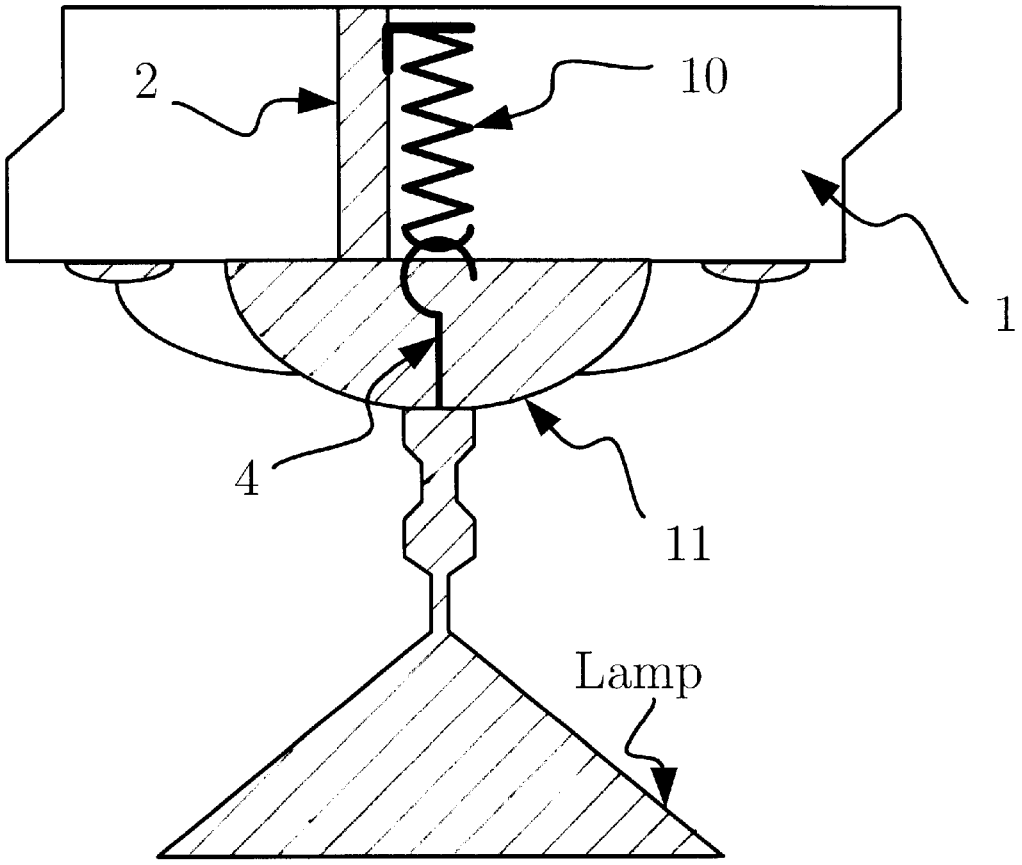
FIG. 1 The procedure to attach a lamp on a ceiling according with this invention.
Figure 1A:
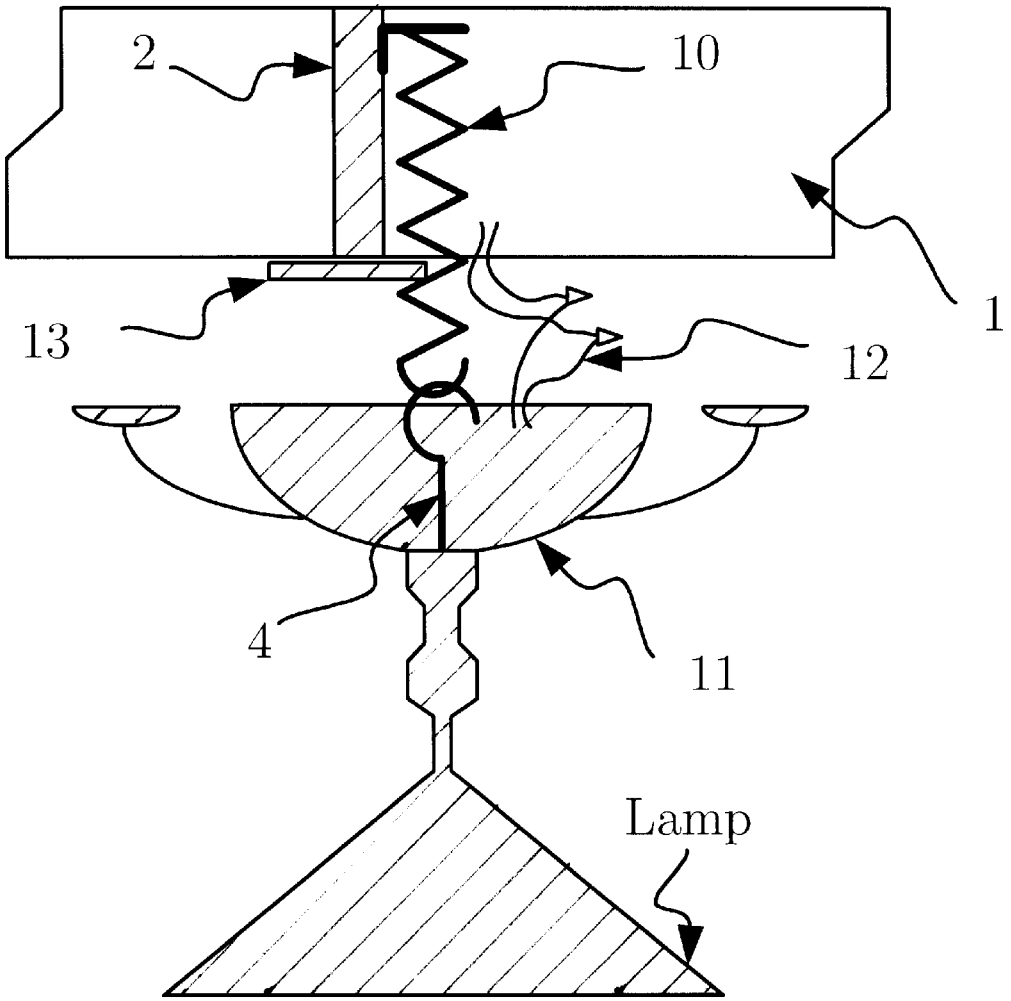
FIG. 1*a* The lamp in the lower position, for electrical connection, according with this invention.
Figure 2:
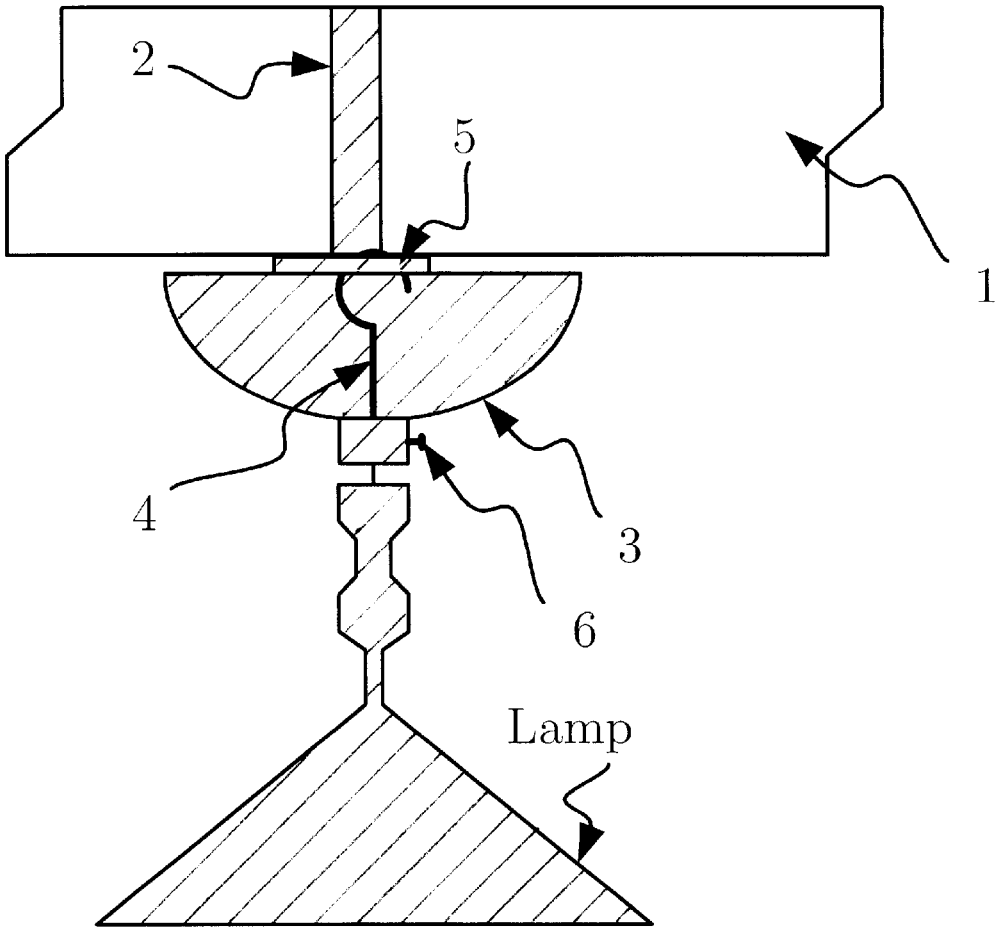
FIG. 2 The existing procedure to attach a lamp on a ceiling.
Figure 3:
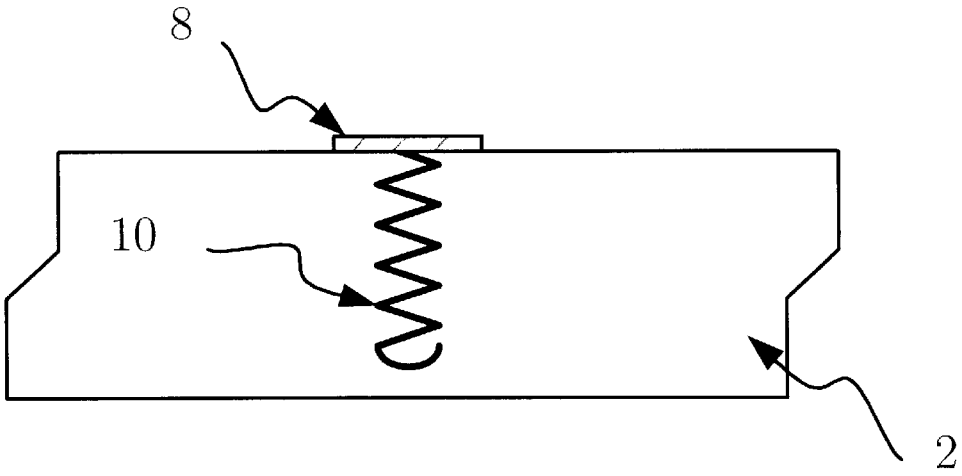
FIG. 3 The hook for a new construction.
Figure 4:
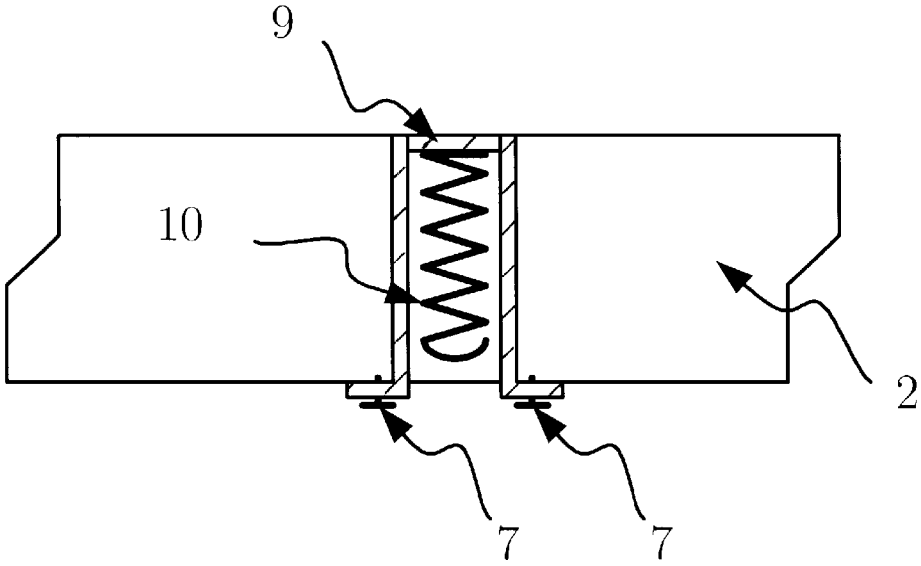
FIG. 4 The hook for an old construction.

The spring 10 has the length smaller than the ceiling 1 width and the diameter of the wire is according to the lamp weigh. The spring 10 has one end fixed, with proper hardware 8 (FIG. 3), on the upper side of the ceiling and the other forms a hook to attach the lamp hook 4. The hardware for new construction 8 (FIG. 3) is fixed on the upper side of the ceiling structure (ex. 2×6 wood) and for old construction, the hardware 9 (FIG. 4) is fixed on the lower side of the ceiling structure with the screws 7 (FIG. 4). ( Old construction means that the upper side of the ceiling is not accessible). Part 11 in FIG. 1 is the upper end of the lamp and is not movable. If the lamp is pulled down, the spring will extend and will be kept so with the blade 13 (FIG. 1*a*). Thus the electrical wire 12 (FIG. 1*a*) are accessible. After connection, removing the blade 13, the spring will contract and will pull up the lamp pressing it against the ceiling.

We claim:

1. The procedure to attach a lamp on a ceiling comprising:

a spring having a first end fixed on the upper side of the ceiling with proper hardware; and a second, opposing end attached to the lamp allowing to pull down the lamp and to connect the electric power; and when releasing the lamp, the lamp is pulled by the spring against the ceiling.

2. The procedure to attach a lamp on a ceiling comprising:

a spring fixed on the upper side of the ceiling with proper hardware and extendible through an opening in the ceiling, the spring attached to the lamp allowing to pull down the lamp and connect the electric power; and when releasing the lamp, the lamp is pulled by the spring against the ceiling.

* * * * *